United States Patent [19]

Garretson

[11] 4,375,798

[45] Mar. 8, 1983

[54] APPARATUS FOR ALTERNATE LIQUID OR GASEOUS FUEL OPERATION OF INTERNAL COMBUSTION ENGINES

[75] Inventor: Keith H. Garretson, Salem, Iowa

[73] Assignee: Garretson Equipment Co., Inc., Mt. Pleasant, Iowa

[21] Appl. No.: 248,430

[22] Filed: Mar. 27, 1981

Related U.S. Application Data

[63] Continuation-in-part of Ser. No. 81,842, Oct. 4, 1979, abandoned.

[51] Int. Cl.[3] ..... F02M 21/02

[52] U.S. Cl. ..... 123/525; 123/575; 261/16; 55/417; 55/DIG. 28

[58] Field of Search ..... 123/575, 576, 577, 578, 123/526, 525, 527, 27 GE; 261/16, DIG. 68; 55/417, DIG. 68

[56] References Cited

U.S. PATENT DOCUMENTS

| | | | |
|---|---|---|---|
| 2,927,848 | 3/1960 | Bauerstock | 55/DIG. 28 |
| 2,939,775 | 6/1970 | Middleton et al. | 123/527 |
| 2,983,592 | 5/1961 | Jones | 55/DIG. 28 |
| 3,282,664 | 11/1966 | Bauerstock | 123/527 |
| 3,421,483 | 1/1969 | Fox | 123/27 GE |
| 3,687,119 | 8/1972 | Hoogeboom | 123/27 GE |
| 3,960,126 | 6/1976 | Shinoda | 123/527 |
| 4,020,810 | 5/1977 | Bauerstock | 261/69 A |
| 4,063,905 | 12/1977 | Johnson et al. | 123/575 |
| 4,098,248 | 7/1978 | Todd | 123/27 GE |

FOREIGN PATENT DOCUMENTS

| | | |
|---|---|---|
| 2243341 | 9/1974 | France . |
| 1469464 | 4/1977 | United Kingdom . |

*Primary Examiner*—Ira S. Lazarus
*Attorney, Agent, or Firm*—Haven E. Simmons

[57] ABSTRACT

An attachment for operating an internal combustion engine on either gaseous or liquid fuel incorporates a modified air cleaner assembly having a cover and an annular adapter between which is sandwiched a typical annular filter element, the adapter fitting over the engine air intake. A diaphragm movably mounts a circular diaphragm plate to the cover to form a chamber therewith on one side of the diaphragm plate and an annular venturi between the other side of the diaphragm plate and the adapter. In one version gaseous fuel is admitted into the chamber through an inlet fitting secured to the cover and thence through ports in the diaphragm plate into the venturi. In another version the gaseous fuel is admitted through an inlet fitting secured to the adapter and thence into the venturi through ports in the adapter, a hose connecting the inlet fitting and the chamber. During gaseous fuel operation pressure of the gas in the chamber in the first version, and gas pressure communicated to the chamber through the hose in the second version, keeps the diaphragm plate adjacent the adapter to maintain the venturi between the two. During liquid fuel operation, however, incoming air lowers the pressure in the chamber sufficiently so that the diaphragm plate automatically moves away from the adapter to provide a largely unobstructed air only path to the engine air intake.

18 Claims, 9 Drawing Figures

APPARATUS FOR ALTERNATE LIQUID OR GASEOUS FUEL OPERATION OF INTERNAL COMBUSTION ENGINES

CROSS REFERENCE TO RELATED APPLICATION

This application is a continuation-in-part of application Ser. No. 081,842 filed Oct. 4, 1979 now abandoned bearing the same title.

BACKGROUND OF THE INVENTION

Dual fuel operation of internal combustion engines, though long known and practiced, is nowadays coming more and more to the fore in view of the growing shortage and cost of liquid fuel, particularly gasoline. Especially in the cases of larger vehicles, such as trucks, motor homes and the like, their innate higher fuel consumption has made the ability to operate them either on liquid or gaseous fuel increasing attractive owing to the relatively plentiful supplies and lower cost of gaseous fuels, such as propane, compared to gasoline.

Currently, several schemes to this end are in practice. Some replace the typical air filter assembly with one which incorporates a fixed venturi arrangement for metering the gaseous fuel. A separate arrangement, exterior of the air cleaner assembly, is usually also fitted for slow-run operation. Some other approaches attempt to incorporate both the main and slow run systems into the air cleaner assembly. These employ, for instance, a diaphragm operated valve which controls a small variable venturi for slow run and a separate fixed large venturi for high speed operation, or a diaphragm operated air valve in conjunction with a fuel valve which together meter both air and fuel throughout the engine speed and load range including slow-run. Examples of these two latter approaches are found in U.S. Pat. Nos. 2,927,848 and 2,983,592, from which it will be readily seen that both are fairly intricate and thus expensive and elaborate to manufacture.

In any event, since all the prior art devices whatever their nature, fit upstream of those means in the engine air intake passage which meter liquid fuel and air in carbureted and fuel injected engines, their paraphernalia of venturis, air valves and the like would improperly throttle air supply and upset functioning of the liquid fuel metering means downstream of air filter assembly when operating on liquid fuel. Hence, the foregoing systems necessarily incorporate some manner by which the incoming air can bypass the gaseous fuel metering and mixing means when the engine operates on liquid fuel. Typically the bypass constitutes a separate or alternate air intake route which is closed off during gaseous fuel operation and opened during liquid fuel operation either manually, as by a handworked cable, or electrically as by a solenoid operated valve. Such a manual approach, of course, requires extra parts and the running of the cable from the engine to the driver's station. The electrical approach, while it can be arranged to operate automatically when the engine is shifted from one fuel to the other, also requires additional, not inexpensive parts and is not always reliable in operation to boot.

Accordingly, the primary object of the present invention is to provide gaseous or liquid fuel operation of an internal combustion engine by means which are simple in structure, inexpensive to produce, efficient in operation, and capable of automatically accommodating either fuel without the need of a separate air bypass route in conjunction with additional manual, electrical or other means for opening and closing the same.

SUMMARY OF THE INVENTION

The foregoing object is achieved in one form by a modified air cleaner assembly which incorporates within it an annular venturi formed between an annular adapter assembly, including an adapter plate which encircles the engine air intake, and one side of a reciprocally movable diaphragm assembly when disposed adjacent the adapter plate. The diaphragm assembly consists of a diaphragm plate surrounded and carried by a thin flexible diaphragm connected at its outer margin to a cover plate to form a chamber with the other side of the diaphragm plate, a typical air filter element being also sandwiched between the adapter and cover plates. In an earlier version of the invention gaseous fuel is supplied to the chamber from the customary zero pressure governor and is drawn from the chamber through a ring of outlet ports through the diaphragm plate at the venturi formed when the latter plate is adjacent the adapter plate, the spacing between the two plates being controlled by adjusting screws. During gaseous fuel operation, gas pressure in the chamber maintains the diaphragm plate in its venturi forming position, but during liquid fuel operation when supply of gaseous fuel to the chamber is closed off, the diaphragm plate automatically retreats from the adapter plate to open up the venturi and provide a substantially unobstructed passage for air only to the engine. The latter movement of the diaphragm plate occurs by virtue of the rush of incoming air past the aforesaid outlet ports in the diaphragm plate which in turn decreases the pressure in the chamber on one side of the diaphragm plate below that exerted on the other side of the latter plate by the incoming air. Hence the need for an alternate air passage and means to open and close it is entirely eliminated.

In a later version of the invention, the gaseous fuel outlet ports are a part of the adapter assembly, rather than of the diaphragm assembly. An annular venturi plate containing the outlet ports is mounted on the adapter plate between the latter and the diaphragm plate in order to form a small annular chamber into which gaseous fuel is piped through an inlet fitting including a main load adjusting valve. The chamber above the diaphragm plate is connected by a hose into the inlet fitting upstream of the metering valve. Two advantages accrue to this version compared with the earlier one: first, bringing the fuel into the smaller rather than the larger chamber requires much less air be purged from the system upon starting up on gaseous fuel. In the earlier version it takes longer to purge the air from the larger chamber above the diaphragm plate, whence the mixture may be excessively lean so that the engine sometimes dies after starting. Correspondingly, with the smaller chamber less gaseous fuel is lost to the atmosphere when the engine is shut down. Second, the earlier version is somewhat tedious to "fine tune" because in order to do so it is necessary to adjust the distance between the adapter and diaphragm plates, that is, the size of the venturi, in order to get the correct air fuel ratio or mixture. Further, the range of such adjustment is necessarily limited so that in order to insure that the correct adjustment is available within that range, the number and size of the gaseous fuel outlet ports in the diaphragm plate have to be quite carefully selected for a particular engine. In the later version, however, the fine tuning is accomplished instead by the main load adjusting valve in the gaseous fuel inlet fitting to the small chamber so that a larger number and size of outlet ports can be used and a range of engine sizes accommodated simply by adjustment of the main load adjusting valve. Were the latter valve to be used in the earlier version, it would necessarily be upstream of the larger chamber above the diaphragm plate with the result that the pressure drop across the valve would so decrease the pressure in that chamber when operating on gaseous fuel that the diaphragm plate would not stay in its venturi position but would tend to retreat to its liquid fuel position and thus "destroy" the venturi. In the later version this misfunction is avoided because the hose connection from the larger chamber above the diaphragm plate into the gaseous fuel inlet fitting is upstream of the main load adjusting valve in that fitting. Furthermore, bringing the gaseous fuel into the smaller chamber in the adapter assembly rather than into the larger chamber above the diaphragm assembly decreases the overall height of the air cleaner assembly when used with a downdraft carburetor and so increases hood clearance.

The parts required for both versions are few and rudimentary insofar as materials and manufacture are concerned, being stamped or spun from simple sheet stock, so cost is low and reliability and efficiency high. For slow-run operation a separate system is employed, such as one admitting the gaseous fuel through a separate valve directly into the engine's intake manifold below the throttle plate, or, as is preferred, one in which the fuel is drawn from the primary regulator, rather than from the zero pressure governor, through a separate line and admitted into the venturi either through the larger chamber in the earlier version or directly into the venturi in the later version, being controlled in both versions by a valve operated by intake manifold vacuum. The latter system constitutes the subject matter of a separate co-pending application for Letters Patent by the inventor hereof. The present invention is suitable for all types of gaseous fuels and, while hereafter shown and described for use with a downdraft carburetor, it can be readily adapted for sidedraft and updraft carburetors or even fuel injection applications in either gasoline or diesel versions. Other features and advantages of the present invention will appear from the more detailed description which follows and the drawings.

DETAILED DESCRIPTION OF THE PREFERRED EMBODIMENTS

Figure 1:
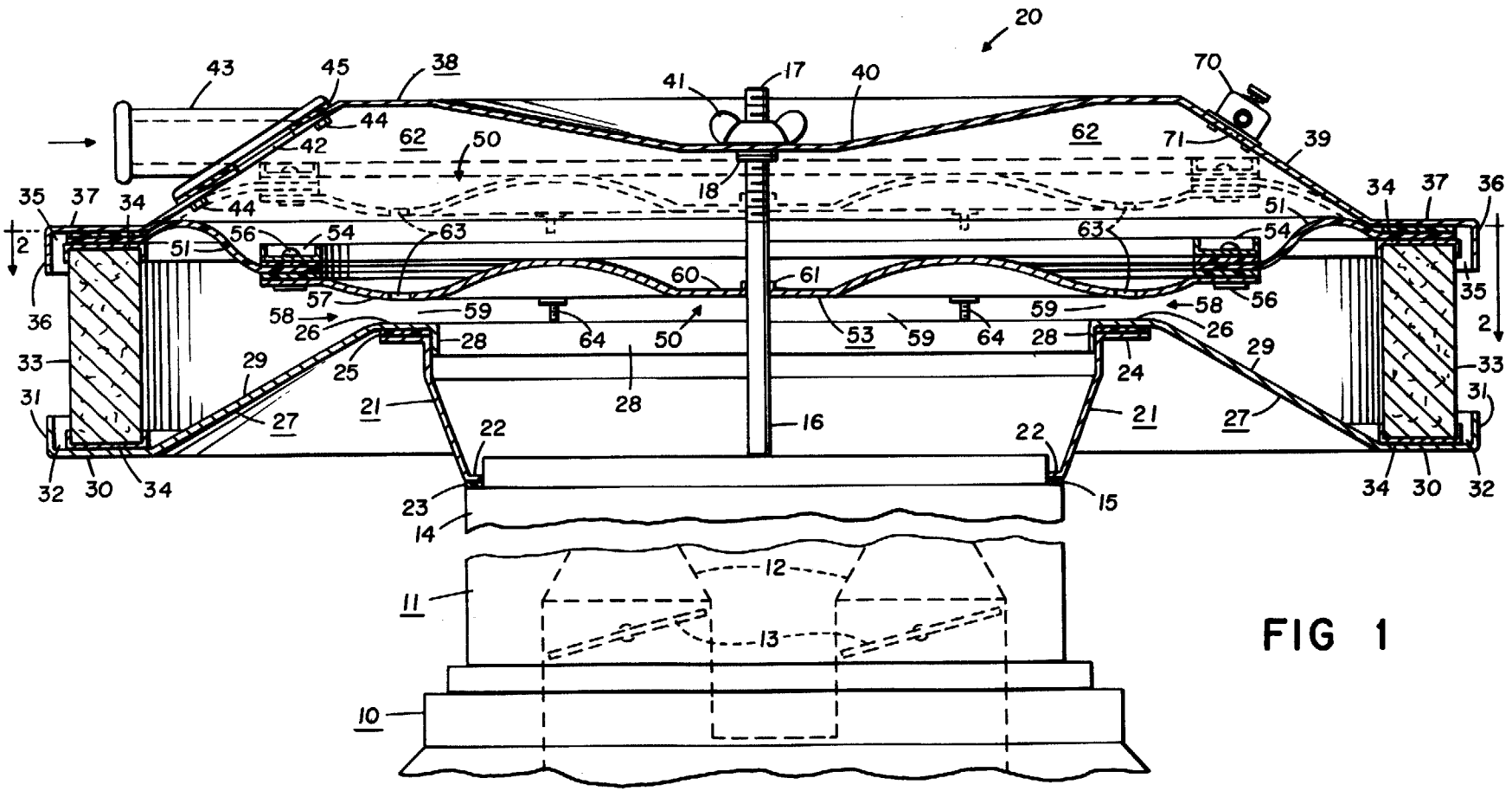
FIG. 1 is a diametrical cross-section of an air cleaner assembly incorporating the earlier version of the invention mounted on the airhorn of a downdraft liquid fuel carburetor.

FIG. 1 depicts an internal combustion engine 10 equipped with a multi-barrel, downdraft carburetor 11 having liquid fuel metering venturi 12 and throttle plates 13 surmounted by a carburetor air inlet horn 14. The air horn 14 includes an annular seat 15 for the lower end of an air cleaner assembly which is retained thereon by a typical hold-down post 16 extending centrally upright from the mouth of the air horn 14, being threaded at 17 at its upper end and provided with a stop collar and gasket 18.

The air cleaner assembly of the earlier version of the present invention, generally indicated at 20, comprises an adapter assembly including an inner annular adapter ring 21 whose lower end 22 is inwardly flanged to press against a gasket 23 about the air horn seat 15 and whose upper end 24 is outwardly flanged and surmounted by a gasket 25. The neck 26 of an outer annular adapter plate 27 seats atop the gasket 25, its inner edge being downwardly flanged at 28 to locate the adapter plate 27 within the upper mouth of the adapter ring 21. (The adapter ring 21 and the adapter plate 27 are preferably separate parts so that the air horns of different carburetors or other air intakes can be more easily and economically accommodated.) The annular surface of the adapter 27 beyond the neck 26 is downwardly flanged at 26 and then outwardly flared to form a shelf 30, the outer edge of the latter having an upturned flange 31 to form an upwardly facing annular seat 32 for the lower end of a typical annular air filter element 33 having gasketed end caps 34. The upper end of the filter element 33 is received in a complementary opposed seat 35 formed by a downturned flange 36 on a shelf 37 at the outer margin of a removable cover plate 38. The latter plate includes an annular wall 39 sloping upwardly from the shelf 37 and a central concavity forming a roof 40 up through which extends the hold-down post 16. The latter post is fitted with a thumbnut 41 in order to retain the adapter ring and plate 21 and 27, the filter element 33 and the cover plate 38 assembled atop the carburetor air horn 14. Despite the concavity of its roof 40, which is to improve underhood clearance by in effect lowering the upper end of the post 16, the cover plate 38 is essentially of inverted dished configuration and its sloped wall 39 is apertured to provide a large main gaseous fuel inlet 42 from a hose fitting 43 in the form of an aluminum casting bolted at 44 with a gasket 45 to the exterior of the wall 39.

Figure 3:
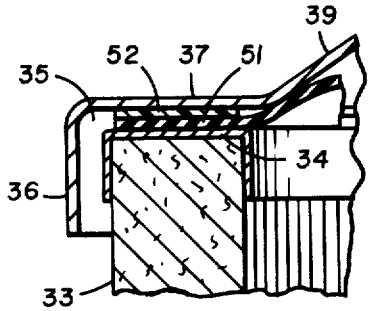
FIGS. 3 and 4 are enlarged sectional views taken respectively along the lines 3—3 and 4—4 of FIG. 2 and illustrating in more detail the mounting of the diaphragm to the cover and diaphragm plates.
Figure 4:
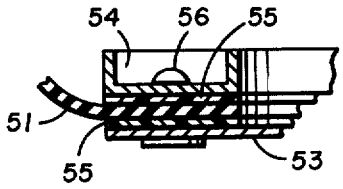

The upper end of the filter element 33 suspends a diaphragm assembly 50 comprising an annular diaphragm 51 of thin flexible material whose outer margin is sandwiched between the upper filter end gasket 34 and an additional gasket 52 (see FIG. 3) in the filter upper end seat 35. The annular intermediate portion of the diaphragm 51 is sinuously disposed as shown in FIG. 1. Its inner margin is sandwiched in turn between the outer margin of a rigid circular diaphragm plate 53 and the outer face of a channel section, annular clamp ring 54, a pair of gaskets 55 (see FIG. 4) being interposed on each side of the diaphragm 51 and the parts secured, for instance, by "Pop Rivets" 56. Radially inward from the clamp ring 54 the diaphragm plate 53 is shaped to form an annular depression 57 whose lower convex face lies closely adjacent the adapter plate neck 26 where, when the diaphragm assembly 50 is in its position shown in full lines in FIG. 1, it forms an annular venturi passage 58 therebetween having an intermediate section or portion constituting a throat 59. The immediate center area of the diaphragm plate 53 is dished at 60 and provided with an upwardly coined aperture 61 which slidably receives the mid-section of the post 16 for guided reciprocal movement of the diaphragm assembly 50 along the post 16, as indicated in FIG. 1. The cover plate 38 and the diaphragm assembly 50 thus define a chamber 62 into which gaseous fuel is admitted through the inlet 42. Through the diaphragm plate 53 at the throat 59 is disposed a ring of spaced gaseous fuel outlet ports 63 from the chamber 62 into the venturi passage 58.

Figure 5:
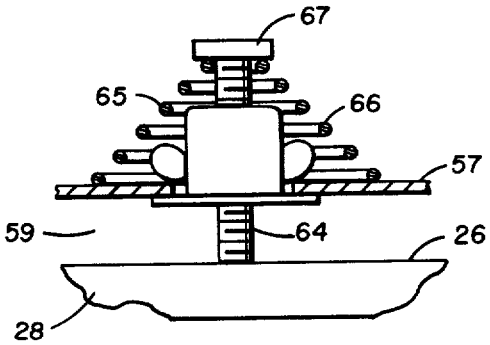
FIG. 5 is a sectional view taken along the line 5—5 of FIG. 2.
Figure 6:
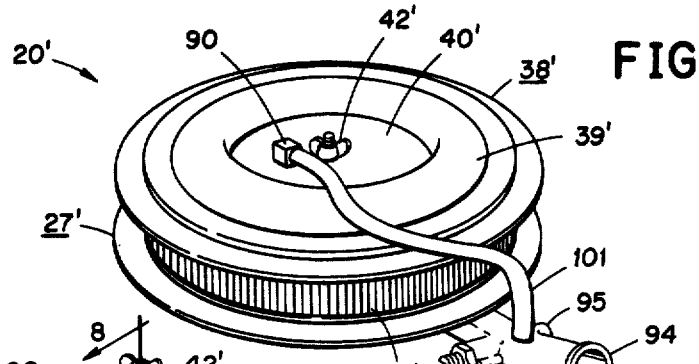
FIG. 6 is a perspective view of the later version of the invention shown in assembled form.
Figure 7:
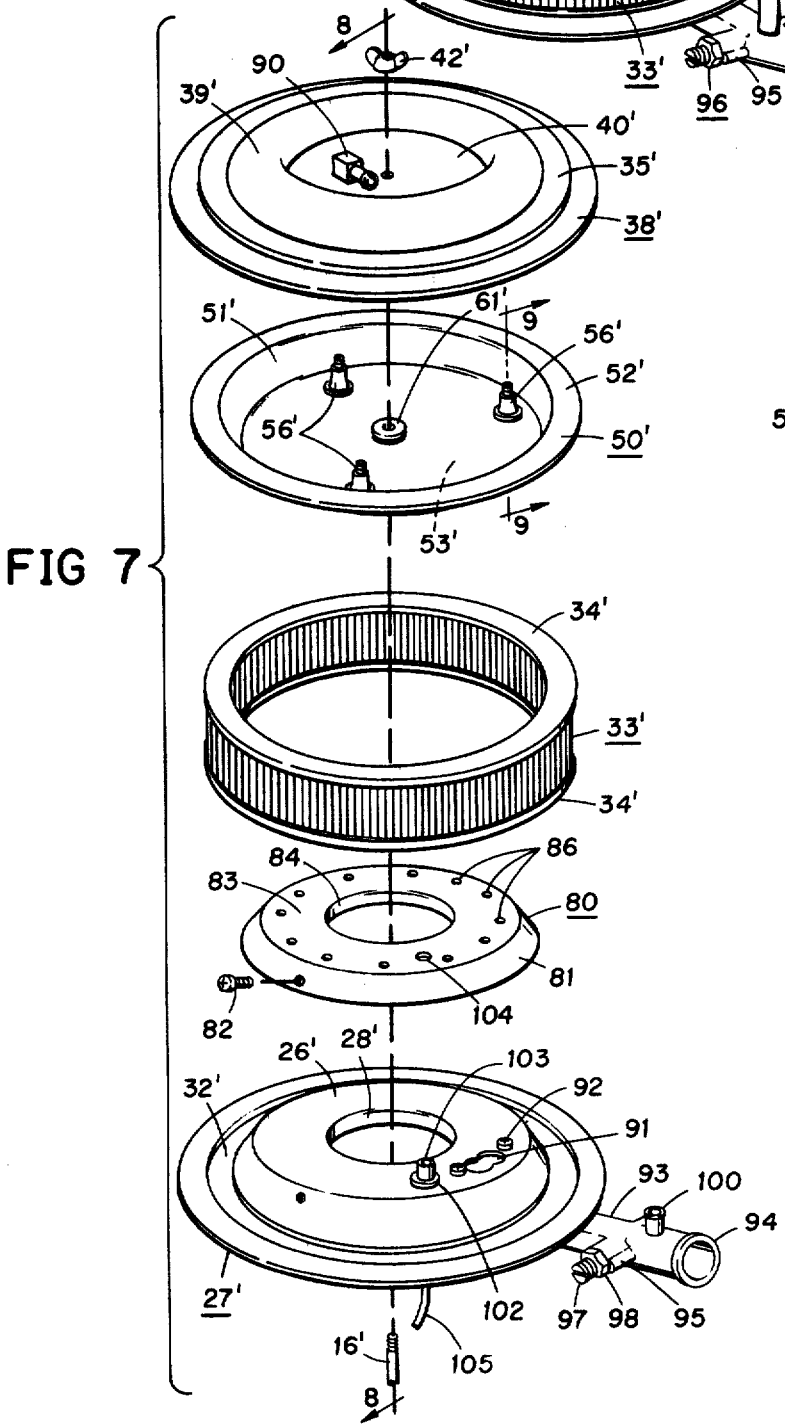
FIG. 7 is an exploded view of the assembly of FIG. 6.
Figure 9:
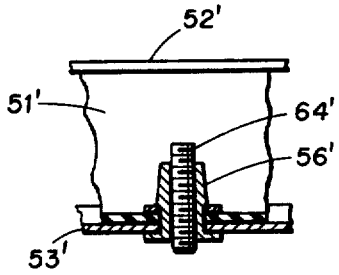
FIG. 9 is a detailed sectional view taken along the line 9—9 of FIG. 7.

The upward travel of the diaphragm assembly 50 is limited by contact of the coined aperture 61 with the stop collar 18, and in order to limit the downward travel of the diaphragm assembly 50, and thus also to adjust the width of the venturi throat 59, the diaphragm plate 53 is fitted with several adjusting screws 64 evenly spaced around the throat 59. The lower ends of the screws 64 engage the adapter plate neck 26 therebelow, the screws 64 being threaded through "Rivnuts" 65, for example (see FIG. 5), crimped in apertures in the diaphragm plate 53 between the outlet ports 63. Conical springs 66 encompass the screws 64 and seat against the under face of their heads 67 to secure the adjustment.

When operating on gaseous fuel, the latter is supplied to the chamber 62 through the inlet 42. The pressure of the gas in the chamber 62 above the diaphragm assembly 50, which is typically in the range of −0.10 to −3.0 inches of water column, maintains the assembly 50 in its lowermost position with the ends of the adjusting screws 64 sitting atop the adapter plate neck 26 to form the venturi passage 58 since that pressure is greater than the pressure of the incoming air below the assembly 50, which is typically in the neighborhood of −0.10 and −0.70 inches of water column respectively upstream and downstream of the throat 59 and −30.0 inches at the latter. Accordingly, the low air pressure at the throat 59 draws gaseous fuel from the outlet ports 63 into the incoming air stream. The annular shape of the venturi passage 58 and the distribution of the outlet ports 63 around it especially enhance gas distribution and mixture with the air. For slow-run operation a typical separate slow-run system may be incorporated into the engine manifold, as previously mentioned, or, as also mentioned, the slow-run system of the present inventor's co-pending application is preferably employed inasmuch as it is both superior and also readily incorporated into the air cleaner assembly 20. The preferred slow-run system takes the form of a valve 70, controlled by manifold vacuum, which introduces gaseous fuel from the primary regulator into the chamber 62 through an inlet 71 in the cover wall 39 opposite the main inlet 42.

Figure 2:
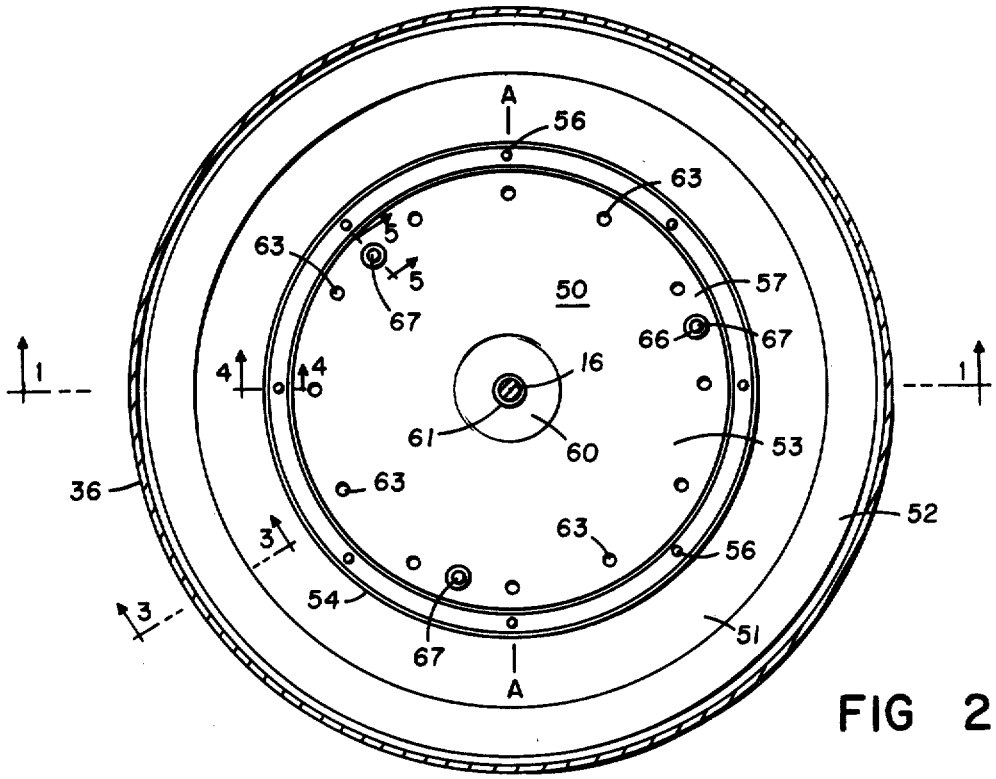
FIG. 2 is a sectional plan view taken along the line 2—2 of FIG. 1.

When operating on liquid fuel, the gaseous fuel supply to the inlet 42 (and the inlet 71) is, of course, closed off. The chamber 62 thereby becomes closed except for the outlet ports 63. The incoming air to the carburetor 11 past the outlet ports 63 lowers the pressure in the chamber 62 against the upper face of the diaphragm assembly 50 below that against the lower face of the latter, whereupon the diaphragm assembly 50 automatically rises, as indicated in broken lines in FIG. 1, toward its uppermost limit against the stop collar 18 depending upon the air demand of the engine. The venturi passage 58 is thus "destroyed" and the incoming air passes substantially unimpeded to the carburetor 11. In short, the assembly 20 then functions just as would a normal air cleaner assembly, as if the diaphragm assembly 50 were wholly absent. It will be appreciated by those skilled in the art that for the diaphragm assembly 50 to rise as aforesaid, its effective area, whose diameter is indicated by the line A—A in FIG. 2, must be sufficient to enable the pressure differential between the opposite sides of the diaphragm assembly 50 to overcome the weight and friction of the latter. This is readily achieved by constructing the diaphragm assembly 50 of light-weight materials.

As will be apparent, the parts of the air cleaner assembly 20 are all simple and straightforward. The adapter ring and plate 21 and 27, the cover plate 38 and the diaphragm plate 53 can all be stamped or spun from sheetmetal such as aluminum. The diaphragm 51 is preferably a 0.008 inch thick sheet of Dacron or Nylon impregnated with epochlorhydron. The overall size of the assembly 20 is also modest, an overall diameter of about 14 inches, a height of about four to five inches between the air horn 14 and the top of the post 16, a diameter of the diaphragm plate 53 between the outlet ports 63 of about six inches, and an outer free diameter of the diaphragm 51 of about 11 inches all being adequate for engines as large 500 cubic inch displacement. The diameter of the outlet ports 63 is preferably between 5/32 and 3/16 inches and their number vary from 4 to 20 or so depending upon engine displacement. Different sized engines can thus be accommodated simply by different diaphragm plates 53 as well as by adjustment of the width of the throat 59 by the screws 64. For side draft and updraft applications, especially the latter, a light coil spring around the post 16 between the stop collar 18 and the coined aperture 63 may be necessary to maintain the diaphragm assembly 50 in its position for gaseous fuel operation.

Turning now to the later version of the invention shown in FIGS. 6–9, essentially similar parts are given the same reference numerals but primed. Here the air cleaner assembly 20' is largely the same in exterior appearance but somewhat shallower in height. The annular adapter ring 21' supports the assembly 20' atop the carburetor air horn 11' with the intervention of the gasket 22'. The annular adapter plate 27' fittingly seats upon the gasket 25' at the upper end of the adapter ring 21', the annular neck 26' of the former extending further horizontally before being flanged downwardly at 29' and then flared horizontally to form the seat 32' for the air filter element 33' having gasketed end caps 34'. The upper end of the filter element 33' engages the opposed seat 35' formed on the outer periphery of the removable cover plate 38'. The latter plate includes an annular convex wall 39' and a central concavity forming the roof 40' up through which extends the hold down post 16' fitted with the thumb nut 42'.

The upper end of the filter element 33' suspends the diaphragm assembly 50' comprising a circular, rather than an annular, diaphragm 51' of the same material as the diaphragm 50 whose outer margin is sandwiched between the upper filter end gasket 34' and the additional gasket 52' between the diaphragm 51' and the seat 35' of the cover plate 38', the gasket 52' being attached to the diaphragm 51' by an appropriate adhesive. To the lower face of the diaphragm 51' is attached the rigid circular diaphragm plate 53' by a circle of "Pop Rivets" 56' and a suitable adhesive. The annular portion of the diaphragm 51' between the gasket 52' and the diaphragm plate 53' is loosely disposed as shown in FIG. 8 and the diaphragm plate 53' itself is essentially flat rather than configured as is the diaphragm plate 53.

Figure 8:
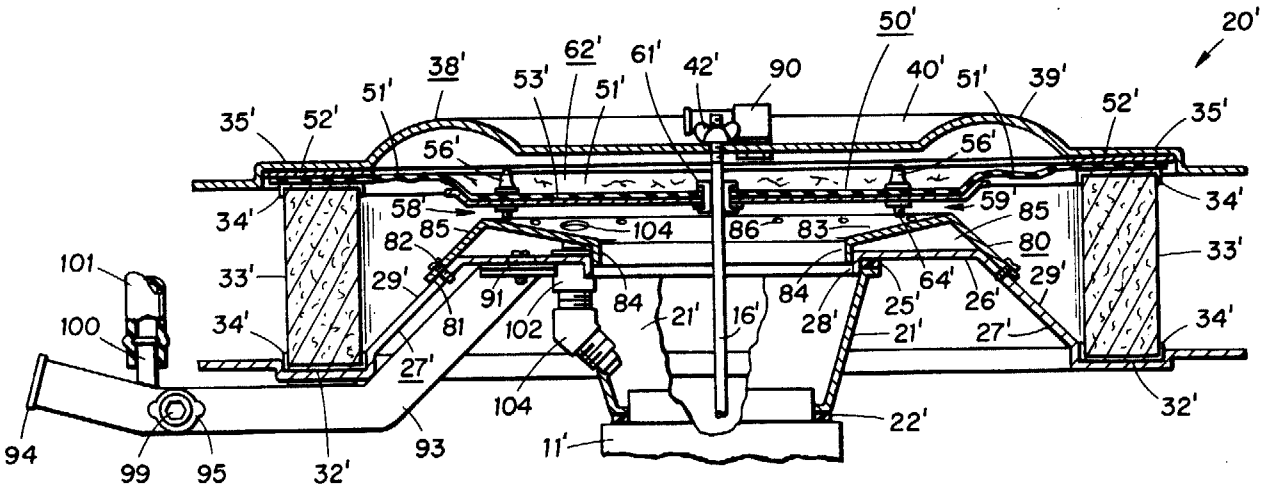
FIG. 8 is a sectional view taken along the line 8—8 of FIG. 7, the assembly being shown in mounted position atop the airhorn of a downdraft liquid fuel carburetor, certain parts being additionally sectioned for illustrative purposes.

In this later version of the invention the venturi is formed by a separate annular venturi plate 80 mounted atop the adapter plate 27' and configured as shown in FIG. 8. The outer skirt 81 of the venturi plate 80 overlaps the sloping flange 29' of the adapter plate 27' and is secured thereto by self-tapping screws 82. The intermediate sloping neck 83 of the venturi plate 80 is spaced above the adapter plate neck 26', an inner annular flange 84 of the plate 80 overlapping the adapter plate flange 28', in order to form a small annular gaseous fuel chamber 85 from which a circle of gaseous fuel outlet ports 86 open up through the neck 83 adjacent its juncture with the skirt 81. The apex between the skirt 81 and the neck 83 together with the diaphragm assembly 50' above them thus forms the annular venturi passage 58' and throat 59' when the diaphragm assembly 50' is in the position shown in FIG. 8.

The diaphragm plate 53' is centrally apertured and fitted with a guide bushing 61' which slidably receives the midsection of the post 16' for guided reciprocal movement of the diaphragm assembly 50' toward and away from the venturi plate 80 in the same manner as in FIG. 1, upward movement of the assembly 50' being limited by the bushing 61' and the roof 40' of the cover plate 38'. In like manner, the cover plate 38' and the diaphragm assembly 50' together define the chamber 62' between the two into which a hose fitting 90 opens through the roof 40' of the cover plate 38'. As shown particularly in FIG. 9, the rivets 56' threadedly receive venturi adjusting screws 64' which engage the venturi plate neck 83 adjacent its apex with the skirt 81 in order to adjust the width of the venturi throat 59'.

Gaseous fuel is admitted to the chamber 85 through a port 91 in the adapter plate neck 26' to the bottom of which in turn is secured by bolts 92 a gasket and the outlet of a large cast aluminum inlet fitting 93 slanting down along the adapter plate flange 29', then under the seat 32' and finally out beyond the outer periphery of the adapter plate 27', terminating in an inlet 94 to which gaseous fuel from the zero pressure governor (not shown) is supplied through a suitable hose. Adjacent its inlet 94 the fitting 93 is provided with a pair of opposite bosses 95. One of the latter carries a main load adjusting valve 96 in the form of a large, finely threaded stud bolt 97 tapped into the boss 95 whose adjustment is secured by a locknut 98, whereby the size of the passage through the fitting past the bolt 97, and thus the amount of gaseous fuel supplied to the chamber 85, can be varied. Into the other boss 95 is threaded a plus 99 for purposes shortly to be described. Between the inlet 94 and the valve 96, and integral with the fitting 93, is a nipple 100 which is connected by a suitable hose 101 to the fitting 90 on the cover plate 38'.

For slow-run purposes gaseous fuel is introduced directly into the venturi throat 59' from an inlet fitting 102, also secured through the adapter plate neck 26', having a stub 103 extending up through the chamber 85 and opening into the throat 59' through an aperture 104 in the venturi plate neck 83. Below the fitting 102 an elbow 105 connects the former through a hose 106 to a valve (not shown) of the nature of the valve 70 in the version of FIG. 1 and also controlled by engine manifold vacuum in order to supply gaseous fuel from the primary regulator directly into the venturi 58'.

When the later version operates on gaseous fuel the same is admitted under low pressure from the zero pressure governor through the inlet fitting 93 into the chamber 85 from which it is drawn out through the outlet ports 86 into the venturi throat 59'. At the same time the pressure of the incoming fuel is communicated through the hose 101 to the chamber 62' above the diaphragm assembly 50, maintaining the latter in its lower position shown in FIG. 8, all in the same manner and for the same reasons as explained in greater detail in the case of the earlier version of the invention. When operating on liquid fuel, then of course access to the fitting 93 is closed off upstream of the latter, whence the fitting 93 in effect becomes an extension of the chamber 85. Hence, the rush of incoming air through the venturi throat 59' decreases the pressure in the chamber 85 and fitting 93, and thence through the hose 101 also in the chamber 62', below that in the venturi 58', so that, as in the earlier version as previously explained at more length, the diaphragm assembly 50' automatically rises toward and remains up adjacent the cover plate 38' and so affords a relatively unobstructed passage for the incoming air. As earlier noted, fine tuning in this case is accomplished by means of the main load adjusting valve 96, the venturi adjusting screws 64' being set initially before assembly on the air horn 11' to give merely an approximately correct mixture. If desired, the plug 99 can be removed and a typical "economizer" valve substituted for it. Such valves are well-known and are controlled by engine manifold vacuum, operating in conjunction with the main load adjusting valve 96 to give a lean mixture under light engine loads and a richer mixture under heavier loads or higher vehicle speeds.

The size of the later version of the invention is also modest, the over-all diameter and height of same depending upon the size of the carburetor air horn and air filter element to accommodated, which in turn depends upon engine displacement and state of tune. The overall dimensions given in the case of the earlier version of the invention are suitable in the later version for engines of up to about 400 cubic inch displacement. A shallower size will serve engines of up to about 300 cubic inch displacement while a taller and wider size will do for engines of up to about 500 cubic inch displacement. And, also as previously pointed out, since a main load adjusting valve 96 for fine tuning can be incorporated in the later but not in the earlier version, the number and size of the fuel outlet ports 86 in the venturi plate 80 are not nearly so critical, whence a single plate with a given size and number of outlet ports can serve a much wider range of engine sizes then was possible in the case of the diaphragm plate 53 of the earlier version. For instance, a circle of 12 outlet ports, each 5/32 inch in diameter, will suit engines up to about 400, and 16 of such ports engines up to about 500, cubic inch displacement. The number of parts required is thus still further reduced.

Finally, rather than requiring a special air cleaner assembly, it is conceivable that either version of the invention could be incorporated in a standard air cleaner assembly by supplying a conversion kit consisting essentially of a diaphragm and diaphragm plate of the foregoing natures plus an adapter assembly to form the other half of the venturi. Some alternate arrangement might also have to be used in the case of the earlier version of the invention in order to supply gaseous fuel to the chamber 62 through the side or from the bottom of the assembly in order not to encroach on underhood clearance involved in bringing the fuel into the top of the assembly. In any event, though the present invention has been described in terms of particular embodiments, being the best modes known of carrying out the invention, it is not limited to those embodiments alone. Instead, the following claims are to be read as encompassing all adaptations and modifications of the invention falling within its spirit and scope.

I claim:

1. An attachment for operating an internal combustion engine having an air inlet on liquid or alternately on gaseous fuel, the attachment including a housing having an opening for the air inlet of an internal combustion engine, the housing comprising: first wall means having a first surface portion; second wall means disposed in spaced relation to the first wall means, a face of the second wall means including a second surface portion disposed in opposed spaced relation to said first surface portion, said first and second surface portions defining a passage therebetween for communicating at an upstream end with the atmosphere and at a downstream end with said opening, at least one of said surface portions being reciprocally movable relative to the other surface portion between first and second positions respectively adjacent and more remote from said other surface portion during engine operation on respectively gaseous and liquid fuel, said passage when said one surface portion is in its first position forming venturi means for controlling supply of gaseous fuel to the engine, said one surface portion when in its second position providing substantially less impedance to flow of air through said passage; a chamber operatively associated with said one surface portion so that movement of said one surface portion between said positions is responsive to difference of fluid pressures in said passage and in said chamber; one or more gaseous fuel outlet ports opening into said venturi means through one of said surface portions and in fluid communication with said chamber during operation of the engine on liquid fuel; and inlet means for supplying gaseous fuel to said outlet ports, said gaseous fuel inlet means being in fluid communication with said chamber during operation of the engine on gaseous fuel.

2. The attachment of claim 1 further characterized by the second wall means partially defining said chamber; and by third wall means disposed in spaced relation to and opposite the other face of said second wall means and further defining said chamber.

3. The attachment of claim 2 further characterized by a periphery of the second wall means being articulately connected to the third wall means to allow said reciprocal movement of the second wall means.

4. The attachment of claim 3 further characterized by the first wall means being a portion of an annular adapter assembly having an annular face portion forming at least part of said first surface portion; by the second wall means being a circular inner member having a face portion forming said second surface portion; and by the third wall means being a circular cover member, the annular assembly, inner member and cover member being all coaxially disposed with respect to each other.

5. The attachment of claim 4 further characterized by said articulate connection being a flexible diaphragm sealingly connected to the inner member and to the cover member to provide an annular flexible diaphragm area between the inner and cover members allowing said reciprocal movement of the inner member; and by adjusting means carried by one of the adapter assembly and the inner member and engaging the other for adjustably varying the distance between said face portions when the inner member is in its first position.

6. The attachment of claim 5 further characterized by the outer peripheral areas of the cover member and adapter assembly additionally defining opposed annular seat portions for receiving an annular air filter element therebetween upstream of said passage; and by means for confining said movement of the inner member to a linear path and for retaining the air filter element in assembled relationship with and between the adapter assembly and the cover member.

7. The attachment of claim 6 further characterized by the adapter assembly having interfitted annular outer and inner portions, one of said annular portions being adapted for engaging the air inlet of an internal combustion engine.

8. The attachment of claims 1, 2, 3, 4, 5, 6 or 7 further characterized by said gaseous fuel inlet means opening into said chamber; and by said gaseous fuel outlet ports opening into said venturi means from said chamber through said second surface portion.

9. The attachment of claims 1, 2, 3, 4, 5, 6 or 7 further characterized by the gaseous fuel outlet ports opening into said venturi means through said first surface portion; and by said gaseous fuel inlet means separately communicating with said outlet ports and said chamber.

10. The attachment of claim 4 further characterized by the adapter assembly including first and second annular members, an annular face of the first annular member constituting said first surface portion and having said gaseous fuel outlet ports opening therethrough, the first and second annular members at least partially defining an annular chamber communicating with said gaseous fuel outlet ports; by means for adjusting the first annular member relative to said inner member when the latter member is in its first portion effective to adjust the spacing between said first and second surface portions; by the gaseous fuel inlet means comprising an inlet member having inlet and outlet ends, said outlet end communicating with said annular chamber; by a gaseous fuel load adjusting valve in the inlet member disposed between said ends thereof; and by said first named chamber communicating through said cover member with said inlet member at a location thereon between said inlet end thereof and said valve.

11. In a system for operating an internal combustion engine on liquid fuel or alternately on gaseous fuel in which the engine has an engine air inlet disposed upstream of means for controlling the supply of liquid fuel and/or air to the engine and intake means communicating with said inlet for mixing air and gaseous fuel from a supply source in proper proportions and supplying the mixture to the engine when operated on gaseous fuel and for providing for a supply of air only to said air inlet when the engine is alternately operated on liquid fuel, the improvement in which the intake means comprises: a first closure member having an opening therethrough communicating with the engine air inlet; a first surface associated with the first closure member and surrounding said opening; a second closure member having opposite faces; a second surface associated with one of said faces of the second closure member and in opposed spaced relation to the first surface, said first and second surfaces defining a passage therebetween communicating at its upstream end with the atmosphere and at its downstream end with said opening; a third closure member, the second and third closure members at least partially defining a chamber on the other face of the second closure member, the second closure member and surface being movable relative to and between the first and third closure members between a first limit position adjacent the first closure member and surface and a second limit position more adjacent the third closure member, said first and second surfaces when the second closure member and surface are in their first limit position forming an annular throat in said passage of venturi shape in cross-section around and adjacent said opening for flow of mixed air and gaseous fuel to said opening, the second closure member and surface when in their second limit position providing for a substantially less restricted flow of air only through said passage to said opening; one or more gaseous fuel outlet ports spaced around said throat and opening thereinto through one of said surfaces, said gaseous fuel outlet ports being in fluid communication with said chamber during engine operation on liquid fuel; and a gaseous fuel inlet in fluid communication with said chamber and said outlet ports for supply of gaseous fuel to said outlet ports at a pressure sufficient to maintain the second closure member and surface in their first limit position during operation of the engine on gaseous fuel, the second closure member and surface being effective to be automatically disposed toward their second limit position when supply of gaseous fuel to said inlet is closed off during operation of the engine on liquid fuel.

12. The system of claim 11 further characterized by the first closure member including a generally annular adapter plate having said opening therein and formed to a cross-sectional configuration providing at least part of said first surface; by the second closure member including a circular diaphragm plate and a flexible diaphragm sheet secured between the diaphragm plate and the third closure member effective to provide said movement of the second closure member, the diaphragm plate having an annular portion disposed coaxially with the adapter plate and forming said second surface; and by guide means for the diaphragm plate for confining said movement thereof to a linear path.

13. The system of claim 12 further characterized by adjusting means carried by said annular portion of the diaphragm plate and engageable through said passage with the annular plate in order to adjust the spacing between said surfaces and thus the first limit position of the diaphragm plate.

14. The system of claims 11, 12 or 13 further characterized by said gaseous fuel outlet ports opening into said chamber through the second surface; and by said gaseous inlet means being carried by the third closure member and also opening into said chamber.

15. The system of claims 11, 12 or 13 further characterized by the gaseous fuel outlet ports opening into said throat through said first surface; and by said gaseous fuel inlet separately communicating with said outlet ports and said chamber.

16. The system of claim 12 further characterized by the annular adapter plate including first and second annular members, an annular face of the first annular member constituting said first surface and having said gaseous fuel outlet ports opening therethrough, the first and second annular members at least partially defining an annular chamber communicating with said gaseous fuel outlet ports; by the gaseous fuel inlet means comprising an inlet member having inlet and outlet ends, said outlet end communicating with said annular chamber; by a gaseous fuel load adjusting valve in the inlet member disposed between said ends thereof; and by said first named chamber communicating through the third closure member with said inlet member at a location thereon between said inlet end thereof and said valve.

17. The system of claim 16 further characterized by a plurality of adjusting means carried by the diaphragm plate and engageable with the first annular member when in its first limit position in order to adjust the spacing between said plate and member and thus said throat.

18. Conversion means for use with an internal combustion engine having an atmospheric air inlet upstream of means for controlling supply of liquid fuel and/or air to the engine, said inlet including an air cleaner assembly having spaced circular and annular closure members and an annular air filter element therebetween, atmospheric air passing first through the filter element and then between said closure members and into the air inlet through the annular closure member, the conversion means converting the air cleaner assembly for operation of the engine on either liquid or gaseous fuel and comprising: a diaphragm assembly and an annular adapter assembly, the diaphragm assembly including a circular diaphragm plate and a flexible diaphragm attached to the diaphragm plate, the outer margin of the diaphragm being securable around an outer margin of the circular closure member to form a chamber between the diaphragm assembly and the circular closure member, the annular adapter assembly being substitutable for the annular closure member, the annular adapter assembly including first and second spaced annular plates forming an annular chamber therebetween in concentric spaced relation to the diaphragm plate, the diaphragm plate being movable by virtue of the diaphragm between the circular closure member and the first annular plate, the diaphragm plate and the first annular plate being effective to provide an annular venturi therebetween when the diaphragm plate is adjacent the first annular plate, the first annular plate having one or more gaseous fuel outlet ports therethrough into the annular chamber; a gaseous fuel inlet fitting having inlet and outlet ends for communicating at its outlet end with the annular chamber through the second annular plate, the inlet fitting being adapted at a location thereon between said ends thereof for communication with the first named chamber through fluid conduit means; and a load adjusting valve disposed in the inlet fitting between its outlet end and said location thereon.

* * * * *